United States Patent [19]

Cosmopulos

[11] 4,395,046

[45] Jul. 26, 1983

[54] HAND THROWN GAME DISC

[76] Inventor: Stavros Cosmopulos, 8 Bridge St., Norwell, Mass. 02061

[21] Appl. No.: 287,304

[22] Filed: Jul. 27, 1981

[51] Int. Cl.[3] ..... A63B 65/10

[52] U.S. Cl. ..... 273/424

[58] Field of Search ..... 273/424, 425; 46/74 D

[56] References Cited

U.S. PATENT DOCUMENTS

| | | | |
|---|---|---|---|
| 1,552,057 | 9/1925 | Jay | 273/424 X |
| 3,220,142 | 11/1965 | Butterfield | 273/425 X |
| 3,544,113 | 12/1970 | Hand | 273/424 |
| 3,613,295 | 10/1971 | Everett | 273/424 |
| 4,151,997 | 5/1979 | Glovak et al. | 273/424 |
| 4,302,901 | 12/1981 | Psyras | 273/424 X |

FOREIGN PATENT DOCUMENTS

| | | | |
|---|---|---|---|
| 181801 | 4/1955 | Austria | 273/424 |

*Primary Examiner*—Paul E. Shapiro

*Attorney, Agent, or Firm*—Morse, Altman & Dacey

[57] ABSTRACT

A game disc is provided for use, in the preferred embodiment, in skipping the same over the surface of water by throwing the toy with a spinning motion and in a generally flat low trajectory. The disc, when made for skipping on water, is of a material having a density less than that water so that it will float. In the preferred mode, the device is in the form of a relatively small disc, preferably having at least one notch at the edge thereof, and formed on one side with an auger face oriented in one direction and on the other side with an auger face oriented in the opposite direction to enhance the motion of the disc and improve its skipping action especially on water. The auger faces provide a lifting motion to the disc and the different auger directions allow the disc to be spun from either hand.

3 Claims, 5 Drawing Figures

HAND THROWN GAME DISC

BACKGROUND OF THE INVENTION

This invention relates generally to game discs and more particularly is directed towards a novel spinnable disc which may be skipped over the surface of water or along a generally flat hard surface.

DESCRIPTION OF THE PRIOR ART

Children as well as adults long have enjoyed themselves in skipping stones over the surface of the water along the shores of oceans and lakes. It is a common sight to see people at beaches looking for a smooth, flat round stone which they try to throw in such a manner that it will skip on top of the water until it sinks. Good throwing stones are not easy to find and even for one skilled in the technique many such efforts prove unsatisfactory because sudden gusts of winds or errant wages cause the stone to strike the water at the wrong angle and sink immediately. Assuming the right conditions of smooth water and a round flat smooth stone properly thrown, the stone will skip a number of times over the water surface, but always at the end will sink and be lost. To make this pastime something of a contest, two or more players may try to obtain the maximum number of skips for each stone. While such a game is enjoyable it is usually short lived because of the constant need to find well-shaped stones which are good for but a single toss and the game further suffers from the fact that a player's skill may be less important than his luck in finding a well-shaped skipping stone.

It is an object of the present invention to provide a new and improved game disc especially useful for skipping over the surface of water.

Another object of this invention is to provide a game disc which will float on water and which is configured on each face to provide a positive skipping action each time it strikes the water to enhance the skipping action.

A further object of this invention is to provide a skipping disc toy formed with auger like top and bottom faces providing a positive lift action when spun against the surface of water.

SUMMARY OF THE INVENTION

This invention features a game disc useful for throwing in a spinning motion and skipped over the surface of water. The disc in its preferred mode is of a relatively stiff material having a density less than that of water and of a size that can be conveniently held in the hand. The disc is formed with upper and lower faces of auger-like configuration, each face pitched in an opposite direction whereby a disc may be spun with one side up for throwing with the right hand or the other side up for throwing with the left hand. The same positive lifting action will occur when striking the water surface.

DETAILED DESCRIPTION OF THE PREFERRED EMBODIMENT

Figure 1:
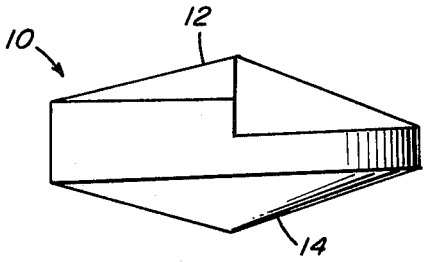
FIG. 1 is a view in side elevation of a game disc made according to the invention.

Referring now to the drawings and to FIGS. 1 through 4 in particular, the reference character 10 generally indicates a game disc, preferably of monolithic construction and which can be fabricated from a variety of different materials such as plastic, wood, rubber or the like. When the disc is used for skipping across the surface of water, it should be fabriacted from a buoyant material so that the disc will float at the end of a toss, making it far easier to retrieve than one that sinks. Each disc may be solid or hollow or may be of a composiet construction comprised of a hard, heavy center portion and a lighter resilient outer portion. In any event, regardless of the construction of the disc, when used as a water skipping toy it should be buoyant, but should still have sufficient density such that a good spinning action can be imparted to the disc. Thus, a very light weight disc while buoyant would not provide good spinning action nor be able to be thrown a long distance as would be the case where the material is of a density just slightly less than that of water.

The disc 10, regardless of the material used in its construction, is generally circular in outline and is formed with top and bottom faces 12 and 14 respectively. While sizes may vary it has been found that a disc with a diameter of approximately $2\frac{1}{2}''$ works satisfacotrily. To provide some body to the disc, its thickness may be about $1\frac{1}{4}''$ at the center and about $\frac{1}{2}''$ at its periphery on the average.

The faces 12 and 14 are characterized by an auger shape matching in pitch but of reversed direction. The top auger surface 12 commences along a radial edge 16 which extends from a center tip 18 to a peripheral edge 20 and extends in a clockwise direction for 360° in a smooth helical sweep or flight terminating at a lower edge 22 of a radial step 24. The height of the step 24 in the preferred embodiment is approximately $\frac{1}{4}''$ at the periphery of the disc although obviously this may be changed depending upon the pitch of the auger face 12. In general, the angle of the auger, as viewed in side elevation of FIG. 1, should be obtuse having the appearance of a very shallow cone and, in practice, it has been found that an angle of approximately 160° provides good results. Obviously, this angle may be varied to some extent. In order to enhance the grip on the disc and to impart the maximum amount of spinning motion to it, a semi-circular notch 26 is provided in the edge of the disc, preferably at a 90° angle to the step 24. While the single notch is shown, obviously one or more additional notches can be provided at spaced intervals.

Figure 4:
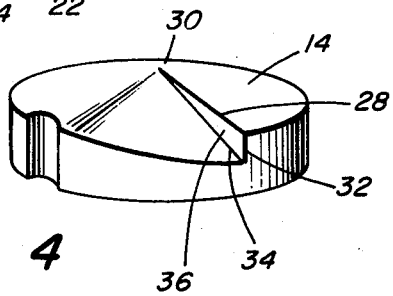
FIG. 4 is a view in perspective showing the device inverted for throwing with the left hand, and, FIG. 5 is a view in perspective showing a modification of the invention.

The face 14 of the disc as shown in FIG. 4 is similar to the face 12 but forms an auger oriented in the opposite direction. In FIG. 4 it may be seen that the auger face originates along a radial edge 28 extending from a peak 30 at the center of the disc and extending out to a peripheral edge 32. The auger face then sweeps helically around in a counterclockwise direction for 360° at a shallow pitch to terminate along a radial edge 34 at the bottom of a radial step 36.

Figure 2:
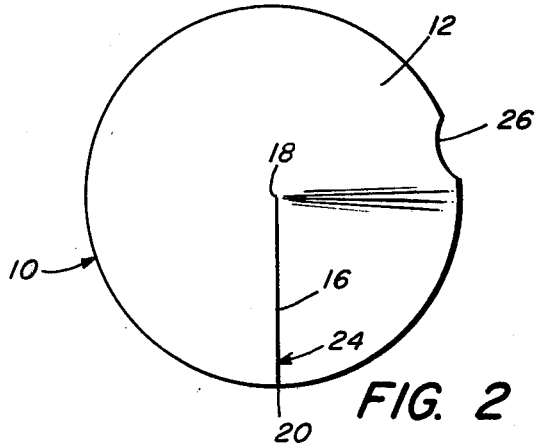
FIG. 2 is a top plan view thereof.
Figure 3:
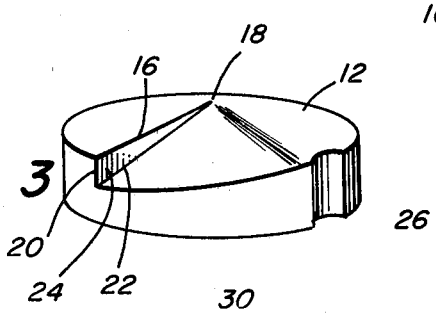
FIG. 3 is a view in perspective thereof in a position for throwing with the right hand.

If the disc is to be thrown by a right handed person it is held in the right hand with auger face 12 facing up as in FIGS. 1, 2 and 3 and with the index finger gripped in a notch 26. The disc is then released by a throwing spinning motion in a generally horizontal attitude low over the surface of the body of water. As the disc contacts the water surface, the spinning lower auger face produces a repelling lift action against the water to enhance the skipping so that the disc properly thrown will bounce out of the water and will repeat the skipping action a number of times until the energy imparted to the disc is exhausted. At that point the disc will come to rest on the water surface where it can be retrieved. To enhance retrieval of the disc it may be made brightly colored to make it more readily visible. In addition to enhancing the skipping action of the device on water, it has also been observed that the auger face enhances the flight and trajectory of the disc through the air.

For a left handed person the disc is turned over so that the auger face 12 will be facing down and, since the disc will be spinning in the opposite direction for a left handed person, the same repelling action will occur since the disc will be spun in the opposite direction.

In order to readily distinguish one side from another, the faces of the disc may be marked "right" and "left" and, in addition, may be differently colored with red and green, for example, so that the thrower can easily determine which face of the disc should be in the up position. It will be understood that if the disc is spun in a direction opposite to that intended, the auger faces will have a negative effect on the skipping action and will tend to reduce rather than enhance the skipping action of the disc.

Figure 5:
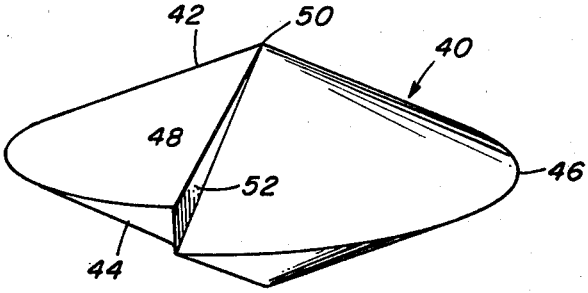

Referring now to FIG. 5 of the drawings, there is illustrated a modification of the invention and in this embodiment there is illustrated a spinnable game disc 40 of the configuration useful in making somewhat larger devices such as a disc perhaps having a diameter of approximately 9", for example. A disc of this size may be thrown in such a manner that the edge of the disc is gripped by the full hand like a discus. The disc 40 is characterized by top and bottom auger faces 42 and 44 similar to the auger faces 12 and 14 of the principal embodiment but larger in size. In this embodiment the disc is made without the surrounding cylindrical periphery since that the faces join together along a generally circular edge 46. In practice, the edge 46 may be somewhat rounded to prevent possible injury should the disc accidentaly strike a player or other party.

In FIG. 5 the upper auger face 42 originates along a radial edge 48 extending from a center tip 50 to the circular edge 46 and sweeping helically around in a auger pitch for 360° where it terminates at a lower base of a step 52. The bottom auger face 44 is similar to the top face but of a reverse direction. The action of the disc 40 is the same of that of the principal embodiment producing a positive skipping action when spun in the proper manner. As before, the top and bottom faces can be identified by a legend "right" for the top and "left" for the bottom and if desired, the faces may be colored differently to further identify the proper position for throwing.

In addition to skipping the disc across water, if it is made of a slightly resilient material to provide some bounce to it, it can also be used on hard surfaces such as hard packed beaches or streets or even a grassy lawn.

The disc may be tossed back and forth by two or more players or each player may be provided with one or more discs each player in turn spinning his or her disc, as desired.

While the invention has been described with particular reference to the illustrated embodiments, numerous modifications thereto will appear to those skilled in the art. For example, the disc can be provided with matching auger faces on top and bottom so that a person who is right handed, for example, may use both sides of the discs. In such case a separate left handed disc would be provided in which the auger faces are pitched in the opposite direction. Alternatively, if desired, one face could be smooth and the other in an auger configuration of either right or left hand direction. Alos, while the auger top is shown being pitched for 360° about each face, the helical pitch could be less than 360°, if desired.

Having thus described the invention, what I claim and desire to obtain by Letters Patent of the United States is:

1. A game disc, comprising:

(a) a generally circular body of monolithic construction formed with top and bottom faces;

(b) at least one of said faces being in the form of an auger flight of up to 360°;

(c) said auger flight defining an obtuse angle of about 160°;

(d) said generally circular body of monolithic construction formed with at least one notch in the peripheral edge thereof;

(e) said game disc being of a solid water bouyant material of composite construction comprising a hard, heavy center portion and a lighter resilient outer portion.

2. A game disc, comprising (a) a generally circular body formed with top and bottom faces, (b) both of said faces being in the form of an auger flight of up to 360°.

3. A game disc according to claim 2 wherein the flight on one face is in a direction opposite to the flight on the other face.

* * * * *